US005990916A

United States Patent [19]

Fassler et al.

[11] Patent Number: 5,990,916

[45] Date of Patent: Nov. 23, 1999

[54] THERMAL COLOR PRINTING BY RECEIVER SIDE HEATING

[75] Inventors: Werner Fassler, Rochester; Charles D. DeBoer, Palmyra; James E. Pickering, Bloomfield, all of N.Y.

[73] Assignee: Eastman Kodak Company, Rochester, N.Y.

[21] Appl. No.: 09/057,933

[22] Filed: Apr. 9, 1998

[51] Int. Cl.[6] ..... B41J 2/325; B41J 31/14; B41J 31/16

[52] U.S. Cl. ..... 347/171

[58] Field of Search ..... 347/171; 400/197, 400/198, 202.4, 202, 202.2

[56] References Cited

U.S. PATENT DOCUMENTS

| | | |
|---|---|---|
| 4,661,393 | 4/1987 | Uchiyama et al. . |
| 5,043,318 | 8/1991 | Kawakami et al. . |
| 5,118,657 | 6/1992 | Kawakami et al. . |
| 5,137,382 | 8/1992 | Miyajima . |
| 5,286,521 | 2/1994 | Matsuda et al. . |
| 5,334,574 | 8/1994 | Matsuda et al. . |
| 5,611,847 | 3/1997 | Guistina et al. . |
| 5,679,139 | 10/1997 | McInerney . |
| 5,679,141 | 10/1997 | McInerney et al. . |
| 5,679,142 | 10/1997 | McInerney et al. . |
| 5,692,844 | 12/1997 | Harrison et al. ..... 400/202.4 |
| 5,698,018 | 12/1997 | Bishop et al. . |

FOREIGN PATENT DOCUMENTS

| | | |
|---|---|---|
| 3-26595 | 2/1991 | Japan . |

OTHER PUBLICATIONS

Venkataraman, The Chemistry of Synthetic Dyes; Academic Press, 1970: vols. 1–4.

The Colour Index Society of Dyers and Colourists, Yorkshire, England, vols. 1–8.

Pigment Handbook; Lewis, P. A., Ed.; Wiley, New York, 1988.

*Primary Examiner*—Huan Tran

*Attorney, Agent, or Firm*—Raymond L. Owens

[57] ABSTRACT

Apparatus for thermal color printing on a moveable receiver including a re-inkable web having at least one colorant; the moveable receiver being in contact with the re-inkable web at a nip position. The apparatus heats the moveable receiver at a position proximate to the nip of the re-inkable web and the moveable receiver so that the moveable receiver maintains sufficient heat to cause colorant to transfer from the re-inkable web to the moveable receiver. Colorant is applied to the re-inkable web after the re-inkable web has delivered colorant to the moveable receiver.

4 Claims, 3 Drawing Sheets

THERMAL COLOR PRINTING BY RECEIVER SIDE HEATING

CROSS REFERENCE TO RELATED APPLICATIONS

Reference is made to commonly assigned U.S. patent application Ser. No. 08/704,297, filed Aug. 29, 1996 entitled "Re-Application of Dye to A Dye Donor Element of Thermal Printers" in the name of Daniel J. Harrison et al, and U.S. patent application Ser. No. 09/058,016 filed concurrently herewith, entitled "Using Laser Light for Thermal Color Printing on A Moveable Receiver" by Fassler et al, the disclosures of which are incorporated herein by reference.

FIELD OF THE INVENTION

This invention relates to laser thermal printing, and, more particularly, to laser thermal printing with a donor which is continually refreshed with colorant during the printing process.

BACKGROUND OF THE INVENTION

Color transfer thermal printers use a color donor member which may be a sheet, but usually is in the form of a web advanced from a supply roll to a take-up roll. The color donor member passes between a printhead and a dye receiver member. The thermal printhead comprises a linear array of resistive heat elements. In operation, the resistive heat elements of the printhead are selectively energized in accordance with data from a printhead control circuit. As a result, the image defined by the data from the printhead control circuit is placed on the receiver member.

A significant problem in this technology is that the color donor members used to make the thermal prints are generally intended for single (one time) use. Thus, although the member has at least three times the area of the final print and contains enough colorant to make a solid black image, only a small fraction of the color is ever used.

After printing an image, the color donor cannot be easily reused, although this has been the subject of several patents. The primary reason that inhibits reuse of the color donor is that the color transfer process is very sensitive to the concentration of the colorant in the donor layer. During the first printing operation, color is selectively removed from the layer thus altering its concentration. In subsequent printings, regions of the donor which had been previously imaged have a lower transfer efficiency than regions which were not imaged. This results in a ghost image appearing in subsequent prints.

The cost associated with having a single use donor ribbon is large because of the large area of ribbon required, as well as the large excess of colorant coated on the donor member. While this technology is able to produce high quality continuous tone prints, it is desired to provide an approach which has all of the good attributes of thermal color transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and low concentration dye layer on the top. The low concentration dye layer meters or controls dye transfer out of the ribbon. This enables the ribbon to be used multiple times. U.S. Pat. No. 5,043,318 is another example of a thermal dye transfer ribbon which can be used multiple times.

Another problem with the resistive head thermal printers described above is high the large amount of energy used by thermal resistive printing. This is because the heat generated by resistive printing head must first heat the support layer before the heat reaches the color donor layer. While the color donor layer can be quite thin and therefore have a low heat capacity, the support layer must be relatively thick, particularly if the support is to be used for multiple printing events without tearing or distorting from the insult of the printing operation.

Yet another problem of the printers described above is that of low resolution images. As the heat from the printhead moves through the support toward the color donor layer, the heat spreads in all directions, so that the spot of color printed is necessarily larger than when it is first generated at the print head. This means the final image is of lower resolution then might be possible with a thinner color donor web.

SUMMARY OF THE INVENTION

An object of this invention is to provide a method and apparatus for printing high quality color images at low cost.

These objects are achieved by apparatus for thermal color printing on a moveable receiver comprising:

a) a re-inkable web;

b) a receiver moveable into contact with the re-inkable web at a nip position;

c) means for heating the receiver at or proximate to the nip of the web and the receiver to cause color to transfer from the web to the receiver; and d) means for applying colorant to the web after the web has delivered colorant to the receiver.

ADVANTAGES

An advantage of this invention is a re-inkable web can be more effectively used for transferring inks to a receiver producing images that have high resolution and are of continuous tone.

Another advantage of the present invention is that printing heat can be produced near the point of contact of the nip of the re-inkable web and the receiver.

A feature of this invention is that the printed images are inexpensive because there is no wasted web material.

Another advantage of this invention is that the color donor web can be made of thick and durable material because it is not necessary to transfer heat through it.

DETAILED DESCRIPTION OF THE INVENTION

Figure 1:
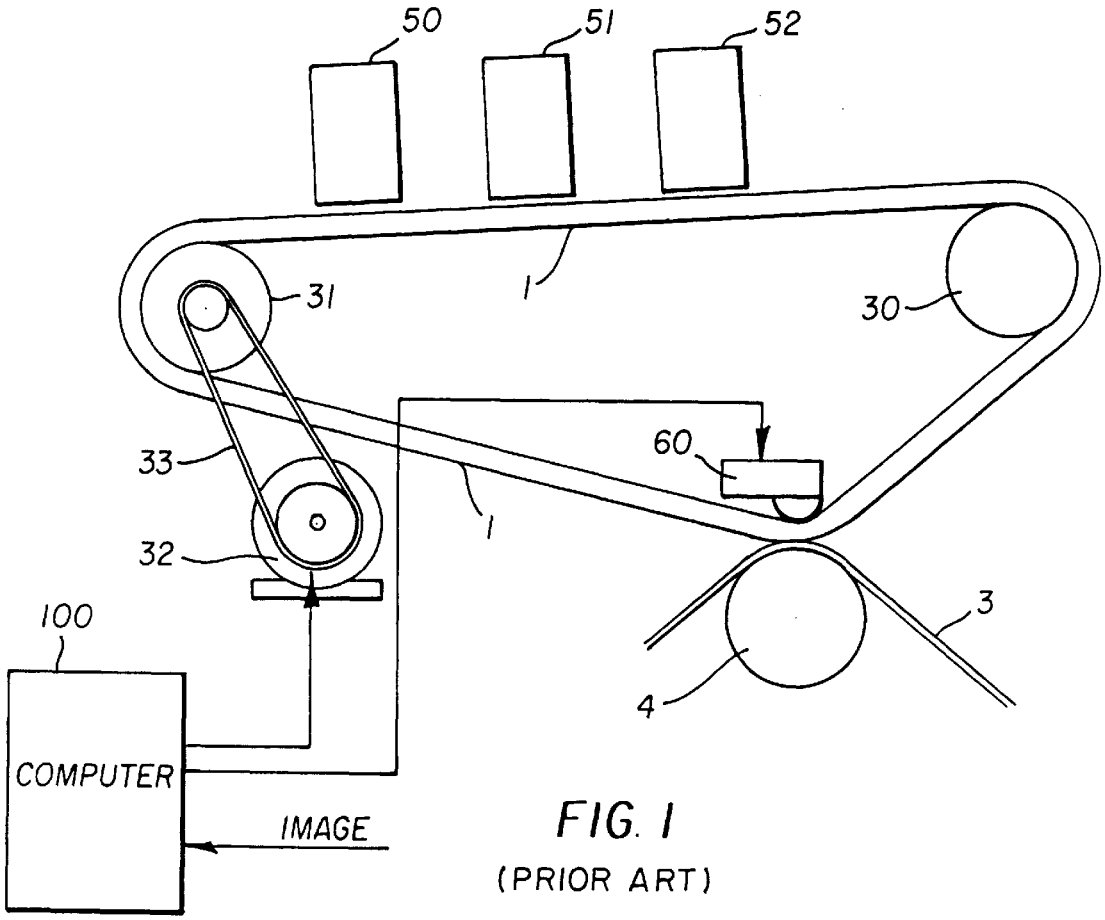
FIG. 1 (PRIOR ART)
FIG. 1 shows a prior art resistive heat printer with a re-inkable web.

Turning to FIG. 1, a resistive heat thermal color donor of the kind described in the above cross reference patent application is shown where a continuous web or belt 1 replaces the one time use donor ribbon (not shown) generic to all thermal dye transfer printers. Stations 50, 51, and 52 re-ink the belt with colorant, in patches of cyan, magenta and yellow color. The colorants are then transferred by the action of the thermal print head 60 to the receiver 3. The belt is driven at printing speed with an electric-motor 32 which drives the transport rollers 30 and 31 with a speed reduction timing belt 33. The electric motor 32 is controlled by a computer 100, which also controls the timing and power to the printing head 60 in accordance with the digital image to be printed. When heat is generated at the printing head 60, it migrates through the belt to the layer of colorant previously deposited colorant at stations 50, 51, and 52. The heat effects the transfer of color to the receiver 3. During the color transfer, the receiver is supported by a platen drive roller 4 so that a close contact nip is established between the donor and the receiver.

Figure 2:
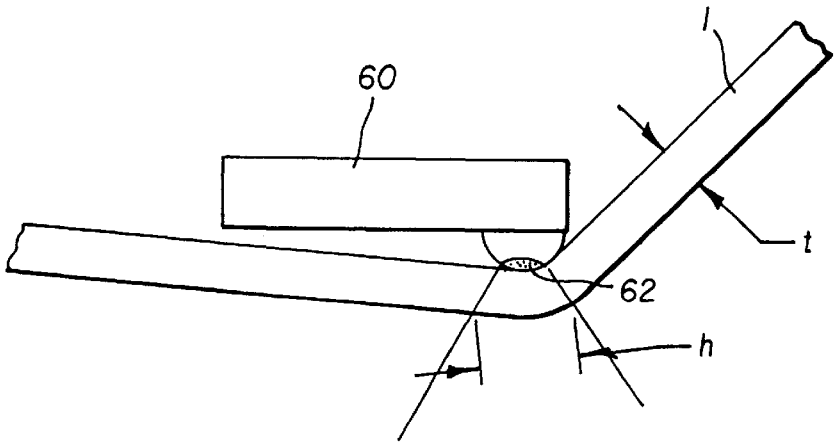
FIG. 2 (PRIOR ART)
FIG. 2 shows a detail of the web of FIG. 1 and illustrates how the web thickness causes the size of the heat pixel to expand and blur the image.

FIG. 2 shows one of the problems caused by this printing arrangement. As the resistive heater 62 heats the donor belt 1, the heat spreads as a spherical function through the donor belt 1. The heat spread causes an enlargement of the printed spot of color as a function of belt thickness shown as "t". Thick belts which can withstand multiple printing cycles yield a large heat spot shown as "h" on the colorant side of the belt 1. The result is that the resolution or sharpness of the printed image is less than would be possible with a thinner belt 1.

Figure 3:
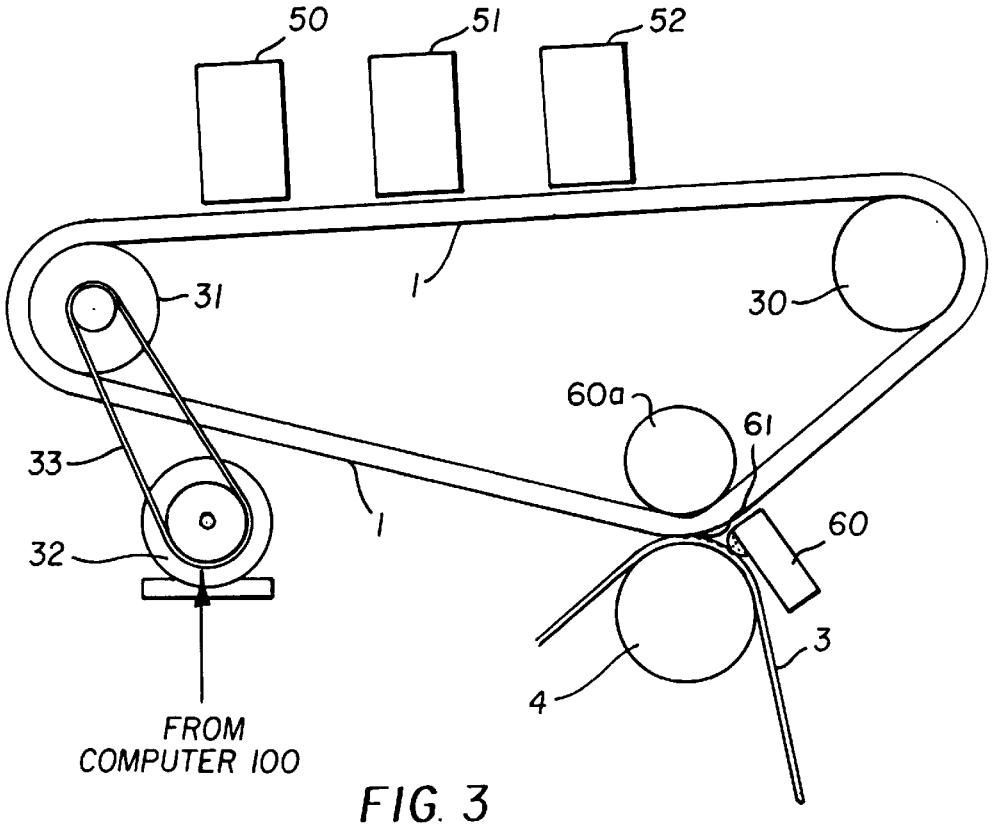
FIG. 3 shows a sectional view through the nip of the apparatus in accordance with the present invention.

FIG. 3 shows the apparatus of the present invention. A thermal print head 60 with contacts the receiver 3 close to the nip 61 between the donor belt 1, the receiver 3, and a back up roller 60*a*. The spots of heat generated by the print head 60 cause diffusion of color from the donor belt 1 to the receiver 3 at the nip 61.

Figure 4:
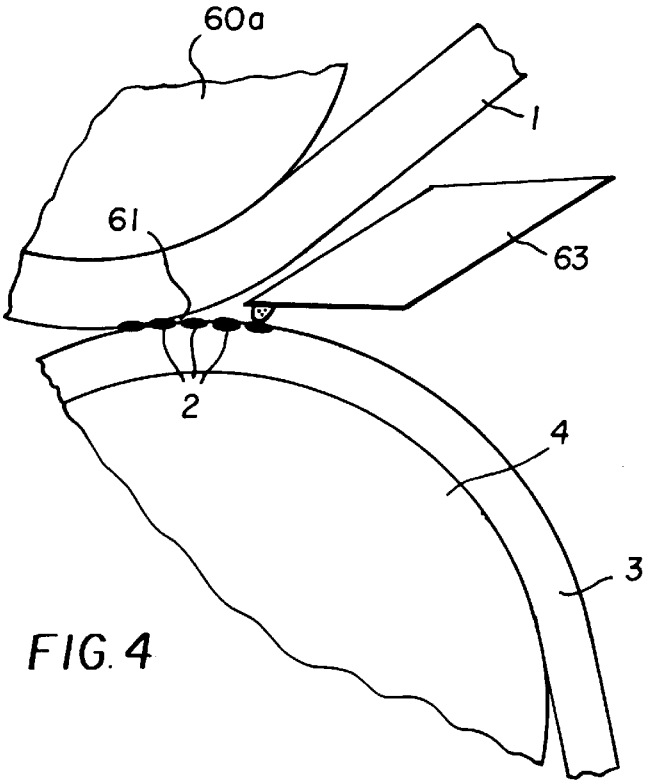
FIG. 4 shows a detail of the nip area of FIG. 3, showing an alternative print head design allowing closer positioning to the nip.

FIG. 4 shows an enlarged view of the nip area of FIG. 3. An alternative shape of print head is shown, illustrating that the resistive printing element of the print head may be closely positioned near the nip 61 with proper design principles.

In order to heat the colorant to effect thermal transfer, the heat spot must not diffuse or cool before contact with the colorant layer is made. Best use insulating bubbles of air in the receiver. These will also help make nice and white.

The colorants used in this invention may be dispersions of pigments in common solvents, or solutions of dyes in such solvents. The liquid colorants that feed the re-inking stations 50, 51 and 52 of this invention are commonly called inks by those skilled in the art. Examples of such inks may be found in U.S. Pat. No. 5,611,847 by Gustina, Santilli and Bugner. Inks may also be found in the following commonly assigned U.S. Pat. Nos. 5,679,139; 5,679,141; 5,679,142; 5,698,018 and in commonly assigned U.S. patent application Ser. No. 08/764,379 filed Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. Preferred examples of dyes used to make solution inks include those listed in Venkataraman, The Chemistry of Synthetic Dyes; Academic Press, 1970: Vols. 1–4 and The Colour Index Society of Dyers and Colourists, Yorkshire, England, Vols. 1–8. Examples of suitable dyes include cyanine dyes (e.g., streptocyanine, merocyanine, and carbocyanine dyes), squarylium dyes, oxonol dyes, anthraquinone dyes, diradical dicationic dyes (i.g., IR165), and polycyclic aromatic hydrocarbon dyes. Similarly, pigments can be included within the thermal mass transfer material to impart color and/or fluorescence. Examples are those known for use in the imaging arts including those listed in the Pigment Handbook; Lewis, P. A., Ed.; Wiley, New York, 1988, or available from commercial sources such as Hilton-Davis, Sun Chemical Co., Aldrich Chemical Co., and the Imperial Chemical Industries, Ltd.

Figure 5:
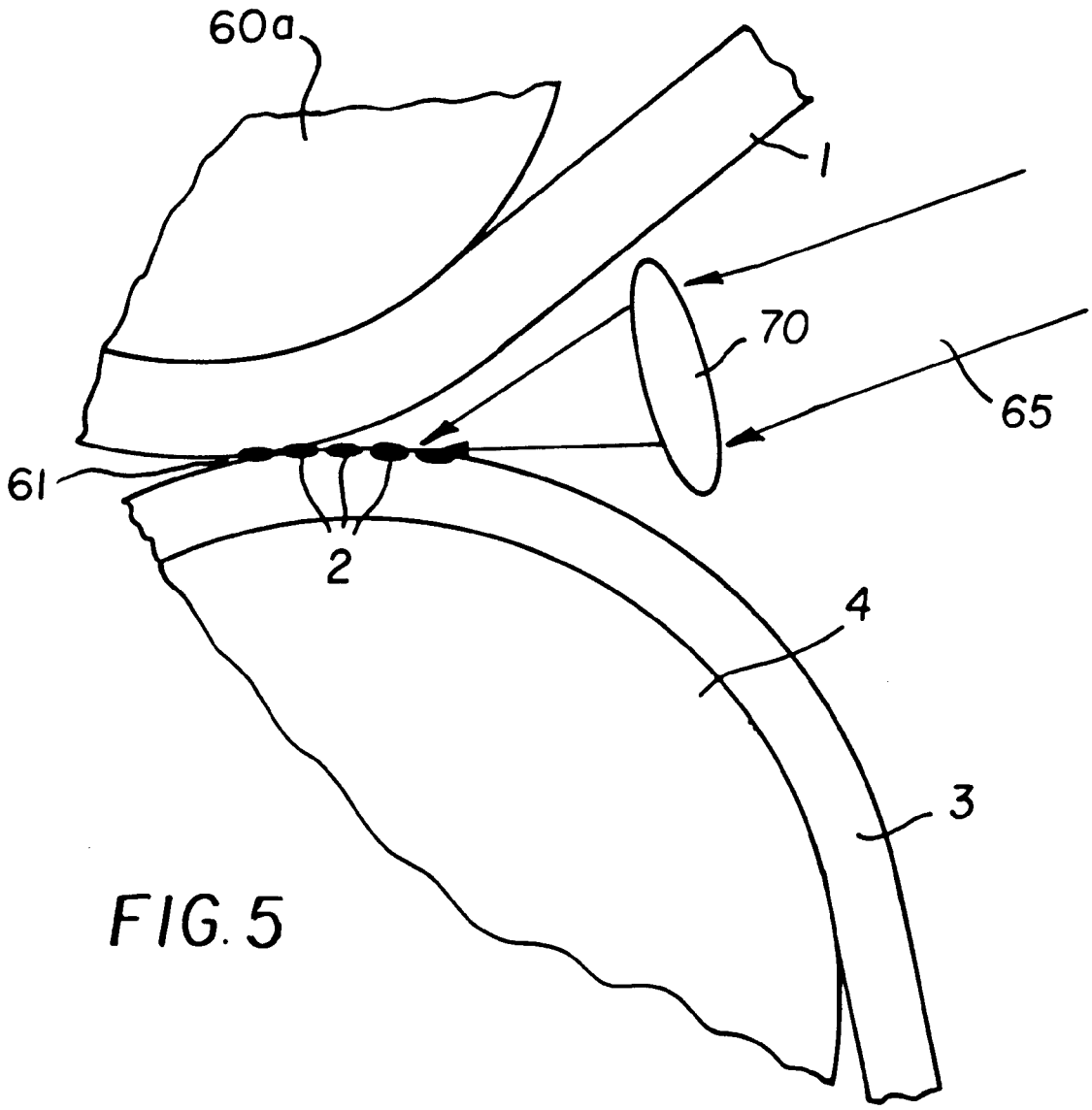
FIG. 5 shows a similar view to FIG. 4, where a focused laser beam is used to heat the receiver.

As shown in FIG. 5, the receiver can also be heated by a laser beam. Need colorless absorber for this purpose. Or use long wavelength laser like $CO_2$. In this method of heating the color donor layer to thermally transfer color in the method of this invention, an intense light source of short duration is used. Short exposure minimizes heat loss by conduction, so improving thermal efficiency. Suitable light sources include flashlamps and lasers. It is advantageous to employ light sources which are relatively richer in infrared than ultraviolet wavelengths to minimize photochemical effects and maximize thermal efficiency. Therefore, when a laser is used it is preferred that it emit in the infrared or near infrared, especially from about 700 to 1200 nm. Suitable laser sources in this region include Nd:YAG, Nd:YLF and semiconductor lasers. The preferred lasers for use in this invention include high power (>100 mW) single mode laser diodes, fiber-coupled laser diodes, and diode-pumped solid state lasers (e.g. Nd:YAG, and Nd:YLF).

The material chosen for the belt I of this invention should be durable, flexible, and capable of uniform re-inking by the colorants. Exemplary materials are thin metal webs such as stainless steel, aluminum and titanium. Polymeric materials may also be employed, provided they are resistant to distortion by high temperature localized heating. An exemplary material is the thermoset polyamide resin Kapton, sold by the DuPont Corporation. Polydimethylsiloxane webs are also useful.

The invention has been described in detail, with particular reference to certain preferred embodiments thereof, but it should be understood that variations and modifications can be effected with the spirit and scope of the invention.

What is claimed is:

1. Apparatus for thermal color printing on a moveable receiver comprising:

a) a re-inkable web having at least one colorant;

b) the moveable receiver being in contact with the re-inkable web at a nip position;

c) means for heating the moveable receiver at a position proximate to the nip of the re-inkable web and the moveable receiver so that the moveable receiver maintains sufficient heat to cause colorant to transfer from the re-inkable web to the moveable receiver, wherein the heating means includes a thermal resistive head having a least one resistive heater in contact with the image side of the moveable receiver and actuable to transfer heat to the moveable receiver further including means for actuating the thermal resistive head in response to an image; and d) means for applying colorant to the re-inkable web after the re-inkable web has delivered colorant to the moveable receiver.

2. The apparatus of claim 1 wherein the actuating means includes a computer responsive to the position of the re-inkable web and the image.

3. The apparatus of claim 1 wherein the re-inkable web has a thickness in a range of 10–200 microns.

4. The apparatus of claim 1 wherein the re-inkable web further includes stainless steel, aluminum and titanium or polymeric materials.

* * * * *